US006298660B1

(12) United States Patent
Daly

(10) Patent No.: US 6,298,660 B1
(45) Date of Patent: Oct. 9, 2001

(54) LOW THERMAL INERTIA INTEGRATED EXHAUST MANIFOLD

(75) Inventor: Paul D. Daly, Troy, MI (US)

(73) Assignee: Siemens Canada Limited, Tilbury (CA)

( * ) Notice: Subject to any disclaimer, the term of this patent is extended or adjusted under 35 U.S.C. 154(b) by 0 days.

(21) Appl. No.: 09/553,197

(22) Filed: Apr. 20, 2000

Related U.S. Application Data

(60) Provisional application No. 60/141,789, filed on Jun. 30, 1999.

(51) Int. Cl.[7] ..... F01N 7/10

(52) U.S. Cl. ..... 60/323; 60/322; 60/282

(58) Field of Search ..... 60/323, 322, 282, 60/272

(56) References Cited

U.S. PATENT DOCUMENTS

| | | | | |
|---|---|---|---|---|
| 3,568,723 | * | 3/1971 | Sowards | 138/143 |
| 3,921,273 | * | 11/1975 | Kondo etla. | 29/157 |
| 3,939,897 | | 2/1976 | Kaneko et al. . | |
| 4,124,732 | | 11/1978 | Leger | 428/77 |
| 4,712,605 | | 12/1987 | Sasaki et al. | 164/516 |
| 4,884,400 | | 12/1989 | Tanaka et al. | 60/323 |
| 4,890,663 | | 1/1990 | Yarahmadi | 164/98 |
| 5,400,830 | | 3/1995 | Stiles et al. . | |
| 5,404,716 | | 4/1995 | Wells et al. | 60/272 |
| 5,404,721 | | 4/1995 | Hartsock | 60/300 |
| 5,419,127 | | 5/1995 | Moore, III | 60/322 |
| 5,687,787 | * | 11/1997 | Atmur et al. | 164/98 |
| 5,692,373 | * | 12/1997 | Atmur et al. | 60/274 |
| 5,888,641 | | 3/1999 | Atmur et al. . | |
| 6,062,268 | * | 5/2000 | Elsasser et al. | 138/121 |

FOREIGN PATENT DOCUMENTS 60078727 5/1985 (JP) .

* cited by examiner

*Primary Examiner*—Thomas Denion
*Assistant Examiner*—Binh Tran

(57) ABSTRACT

A non-metallic vehicle gas-directing component includes a plurality of ceramic members embedded within an inner surface. The ceramic members extend into a passageway to form a boundary layer between the flow of exhaust gas and exposed portions of the inner surface to provide a highly heat resistant and lightweight passageway for directing a high temperature gas. A method for producing the vehicle gas-directing component includes temporarily attaching a plurality of ceramic members to an inner mold core during a lost core molding process. In one disclosed embodiment, the ceramic members are temporarily attached directly to the inner mold core by an adhesive. In another disclosed embodiment, the plurality of ceramic members are attached to an inner contour of a core casting cavity by an adhesive.

16 Claims, 6 Drawing Sheets

LOW THERMAL INERTIA INTEGRATED EXHAUST MANIFOLD

The present application claims priority to United States Provisional Patent Application Ser. No. 60/141,789, filed Jun. 30, 1999.

BACKGROUND OF THE INVENTION

The present invention relates to a vehicle gas-directing component, and more particularly to a non-metallic exhaust manifold with an inner surface having a plurality of embedded ceramic members.

Various types of exhaust manifolds have been used in the field of internal combustion engines. Known exhaust manifolds are typically manufactured of a heat resistance metal such as cast iron to resist the high temperature exhaust gas emitted from the vehicle engine. However, these known manifolds are relatively heavy and tend to absorb much of the thermal energy generated by the exhaust gases.

In order to reduce their weight, some known exhaust manifolds are constructed of a light metal such as aluminum. When using such a material for an exhaust manifold, it becomes necessary to line or coat the inner surface with a heat insulating material such as a ceramic. In one known exhaust manifold, a ceramic fiber layer coats the inner surface of the aluminum exhaust manifold. However, because of the great difference in the thermal expansion properties of metals and ceramics, prolonged use tends to induce undesirable separation of the ceramic layer from the metallic surface. Separation of the ceramic fiber layer typically results in the destruction of the light metal surface by the high temperature exhaust gas.

Known iron exhaust manifolds have a high thermal conductivity and tend to immediately absorb much of the thermal energy generated by the exhaust gases. High thermal conductivity can be a disadvantage as the exhaust system catalyst can not immediately "light off" and a high percentage of total emissions occur before the catalysts are active. It would therefore be further desirable to prevent the exhaust manifold from absorbing the heat of the exhaust gases and allow the residual heat to activate the downstream catalytic converter. The catalytic converter will then "light off" earlier and will operate with higher efficiency which may effectively reduce the emission levels of the engine.

Accordingly, it is desirable to provide a lightweight vehicle gas-directing component which can resist the highly heated exhaust gas emitted from the vehicle engine.

SUMMARY OF THE INVENTION

The present invention provides a non-metallic vehicle gas-directing component having a plurality of ceramic members embedded within an inner surface and a method for producing the same. The inner surface preferably defines an exhaust passageway within an exhaust manifold for directing exhaust gas away from a vehicle engine.

The ceramic members are embedded within the inner surface to be in direct contact with the exhaust gas. Notably, the ceramic members need not form a completely continuous layer along the inner surface. Because the ceramic members extend into the exhaust passageway, a boundary layer is formed between the flow of exhaust gas and exposed portions of the inner surface. The exhaust gas, although impacting the ceramic members, tends to flow over the exposed inner surface portions because of the boundary layer.

The method for producing a vehicle gas-directing component preferably includes temporarily attaching a plurality of ceramic members to an inner mold core during a lost core molding process. In one disclosed embodiment, the ceramic members are temporarily attached directly to the inner mold core by an adhesive. In another disclosed embodiment, the plurality of ceramic members are attached to an inner contour of a core casting cavity by an adhesive. By temporarily tacking the ceramic members to the inner contour, the ceramic members will be transferred to the outer contour of the inner mold core.

The next step includes placing the inner mold core having the ceramic members attached to its outer contour within an outer core casting cavity and overmolding a non-metallic material over the surface of the inner mold core. The outer mold is sealed and the non-metallic material for forming finished component is injected or otherwise filled in between the inner mold core and outer core casting cavity of the outer mold. During the setting of non-metallic material, the ceramic members become embedded within what will become the inner surface of the finished component.

After the non-metallic material is set within the outer core casting cavity, the finished component is removed and the inner mold core is destructively removed leaving the ceramic members embedded in the inner surface of the finished component. The inner surface of the finished component now includes the plurality of embedded ceramic members to provide, for example, a highly heat resistant and lightweight exhaust passageway for directing the exhaust gas as described above.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows:

FIG. 6AA is a schematic illustration of an alternate step that replaces the steps illustrated in FIG. 6A and 6B;

DETAILED DESCRIPTION OF THE PREFERRED EMBODIMENT

Figure 1:
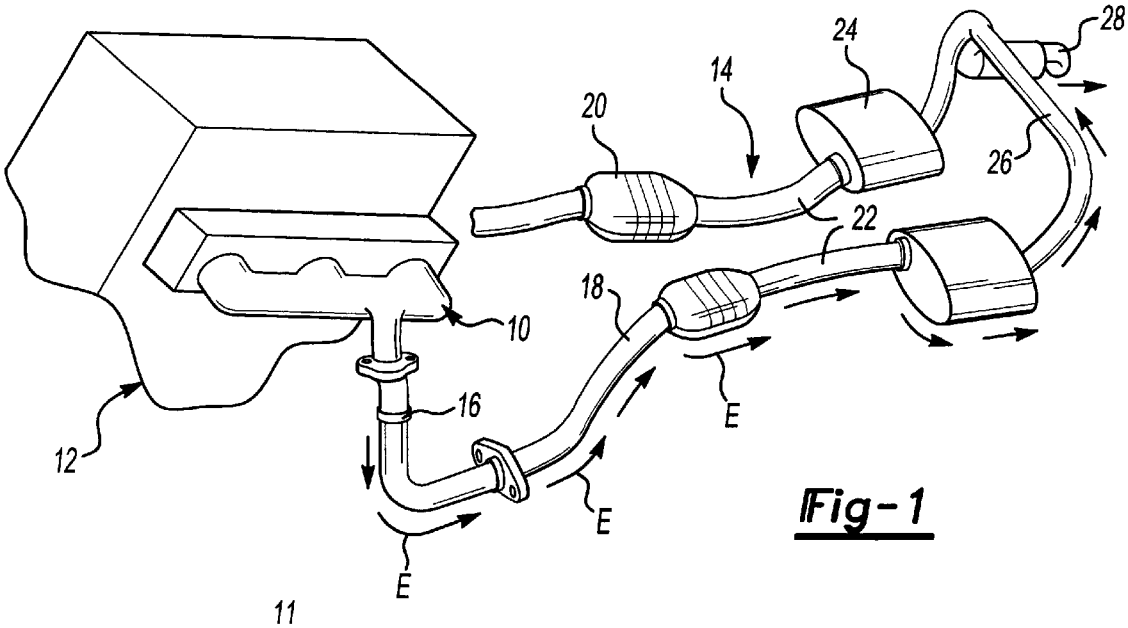
FIG. 1 is a general perspective view of a vehicle exhaust system having an exhaust manifold designed according to the present invention.

FIG. 1 illustrates a vehicle gas directing component 10 such as an exhaust manifold 10 affixed to an engine 12 and exemplary exhaust system 14. The exhaust system 14 typically includes an exhaust pipe 16, a connecting pipe 18, a catalytic converter 20, a straight pipe 22, a muffler 24, a second connecting pipe 26 and a tail pipe 28.

In general, the engine 12 produces exhaust gas from the cylinders (not shown) which exit through the exhaust manifold 10. The exhaust gas, as schematically illustrated by the directional arrows E, passes through the exhaust manifold 10, through the exhaust pipe 16, connecting pipe 18 and the catalytic converter 20. The exhaust gas E continues through the catalytic converter 20, to the straight pipe 22, through the muffler 24, the second connecting pipe 26 and out into the atmosphere through the tail pipe 28.

Figure 2:
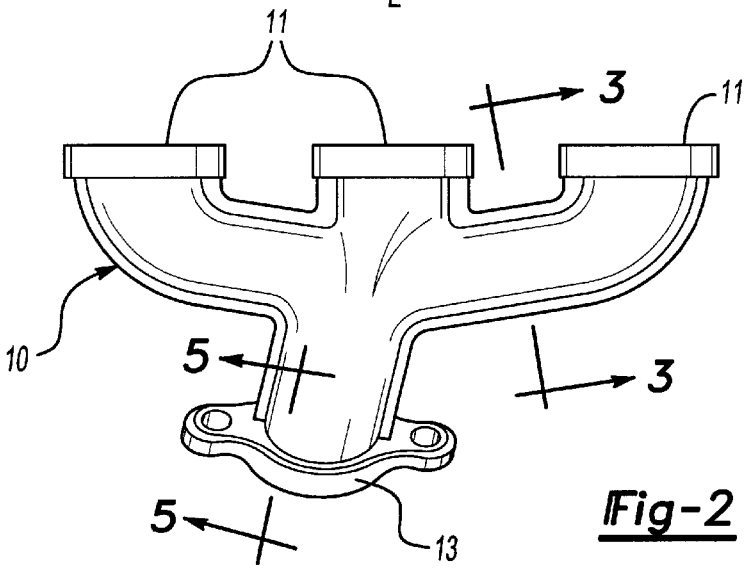
FIG. 2 is an expanded view of the exhaust manifold of FIG. 1.

Referring to FIG. 2, the exhaust manifold 10 includes inlet flanges 11 and an outlet flange 13. In use, the inlet flanges 11 are attached to the exterior of the engine block to mount the manifold thereon and the outlet flange 13 is attached to the exhaust system (FIG. 1).

Figure 3:
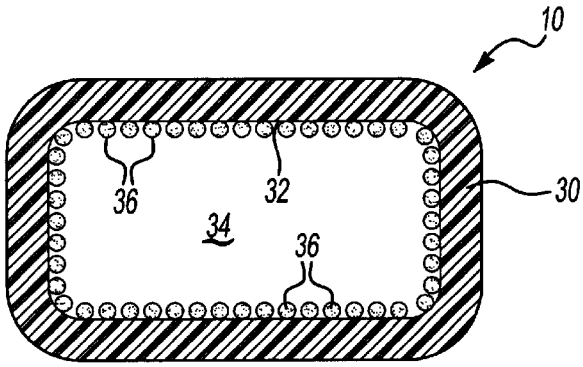
FIG. 3 is a sectional view of the exhaust manifold of FIG. 2 taken along the line 3—3.

Referring to FIG. 3, a sectional view of the manifold 10 is illustrated. The manifold 10 has an outer surface 30 and an inner surface 32. The outer surface 30 is preferably manufactured of a non-metallic material such as nylon, PET, LCP, PPC, PBT or various other plastics. The inner surface 32 defines an exhaust passageway 34 for directing the exhaust gas away from the engine 12 (FIG. 1).

The inner surface 32 preferably includes a plurality of embedded ceramic members 36. The ceramic members 36 are positioned at least partially within the inner surface 32. The ceramic members 36 are preferably cast in place, as will be discussed in further detail below with respect to the method of manufacture of the present invention, such that the inner surface 32 is substantially coated with the ceramic members 36.

Figure 4A:
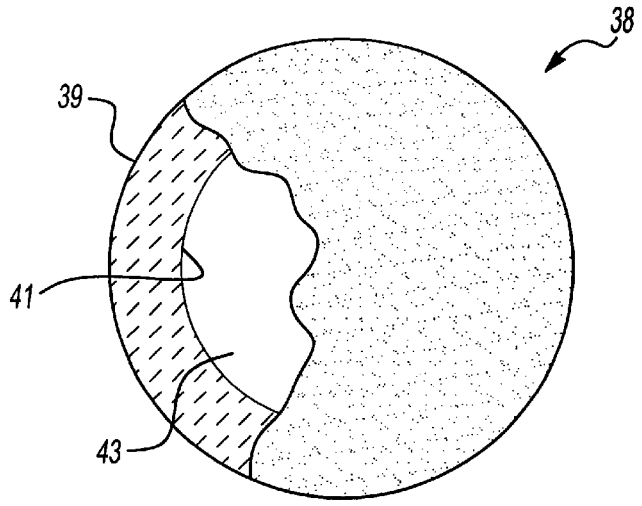
FIG. 4A is an enlarged partially fragmented sectional view of a ceramic member according to the present invention.

Referring to FIG. 4A, one disclosed embodiment provides a plurality of hollow ceramic spheres 38. A preferred hollow ceramic sphere 38 has an outer surface 39, and an inner surface 41 which defines the shape of an inner cavity 43. The preferred hollow ceramic sphere 38 has an outer diameter between approximately 0.75 to approximately 1 inch. The inner cavity 43 may be filled with a gas, for example air, or may be substantially devoid of gas, as in a vacuum.

Figure 4B:
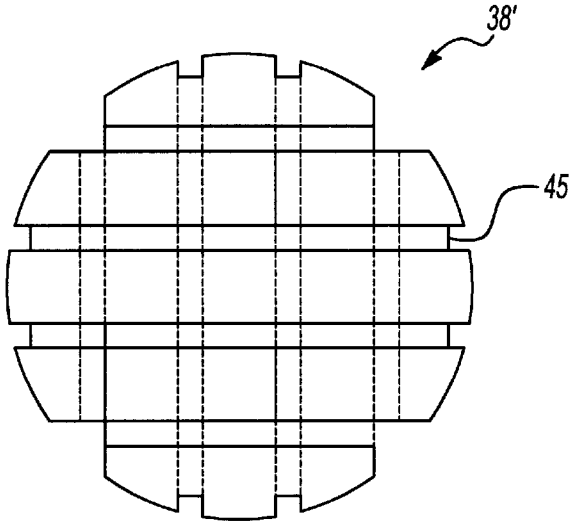
FIG. 4B is an enlarged partially fragmented sectional view of a ceramic member according to the present invention.

Referring to FIG. 4B, another disclosed embodiment provides a ceramic sphere 38' having a plurality of grooves 45. The grooves 45 assist in the retention of the ceramic spheres 38' within the inner surface 32. Although, the grooves 45 are illustrated in a substantial checkerboard pattern, it should be realized that other groove orientations are contemplated.

It is contemplated that the manifold 10 may have ceramic members 36 embedded therein which are not spherical in shape and are not of a consistent shape or size. For example only, granular, cubic, elliptical, and rectangular shaped ceramic members are also within the scope of the present invention, as is any shape that is amenable to disposition on the inner surface 32.

Figure 5:
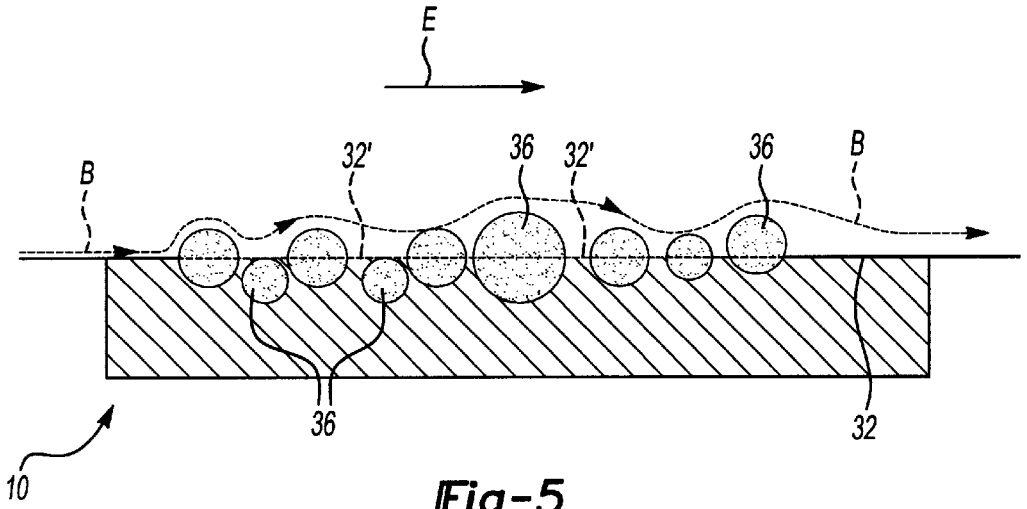
FIG. 5 is a sectional view of the exhaust manifold of FIG. 2 taken along the line 5—5 in FIG. 2.

Referring to the sectional view of FIG. 5, the ceramic members 36 are embedded within the inner surface 32 of the manifold 10 in direct contact with the exhaust gas E from the engine 12. Notably, the ceramic members 36 need not form a completely continuous layer along the inner surface 32. As illustrated, inner surface portions 32' are exposed through the layer of ceramic members 36. Preferably the ceramic members 36 are arranged in relation to the direction of the exhaust gas E. Because the ceramic members 36 extend into the exhaust passageway 34, a boundary layer B is formed between the flow of exhaust gas E and the exposed inner surface portions 32'.

The exhaust gas E, although impacting the ceramic members 36, tends to flow over the exposed inner surface portions 32' because of the boundary layer B. The exposed inner surface portions 32' are thereby not directly impacted by the exhaust gas E and the resulting high temperatures. The allowable size and spacing of the ceramic members 36, and the allowable size, spacing, and temperature exposure of the exposed inner surface portions 32' in part depends on the boundary layer. Calculation of these parameters is commonly determinable in the art of fluid dynamics and such calculations will not be further detailed herein.

The ceramic members 36, the inner surface 32 and the outer surface 30, have different thermal expansion coefficients and encounter different temperatures. The surfaces will therefore expand and contract relative to each other. The substantially non-continuos layer of ceramic members 36 allows for this differential mechanical and thermal expansion. Thus, the probability of fracture over an extended time period commonly associated with continuos layers of ceramic material affixed to materials of differing thermal and mechanical expansion is reduced. Each ceramic member is of such a small dimension that the difference between its cold site and its hot site is a small amount. The plastic will easily accommodate this amount.

A method for producing the above mentioned exhaust manifold will now be described. However, it should be realized that the use of an exhaust manifold is for illustrative purposes only, and that the methodology of the present invention may be applied to any other gas ducting vehicle components.

Figure 6A:
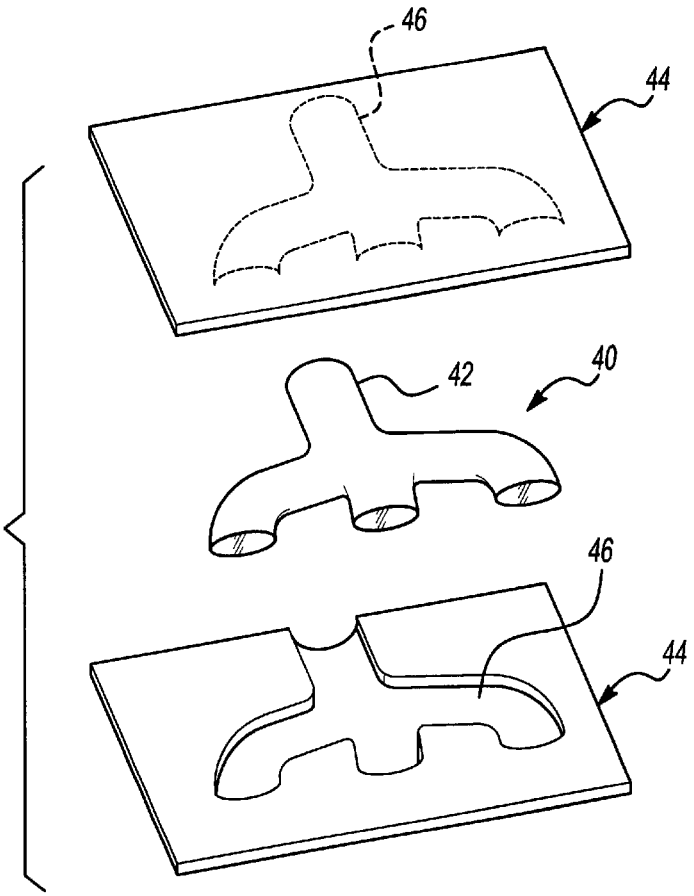
FIG. 6A is a schematic illustration of a step of the method of manufacture of the present invention.
Figure 6A:
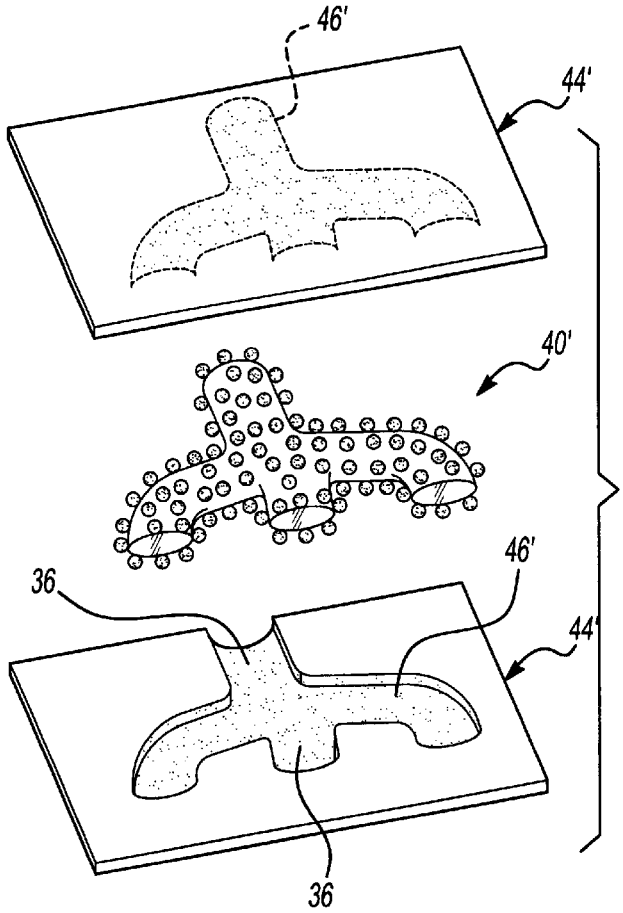
Figure 6B:
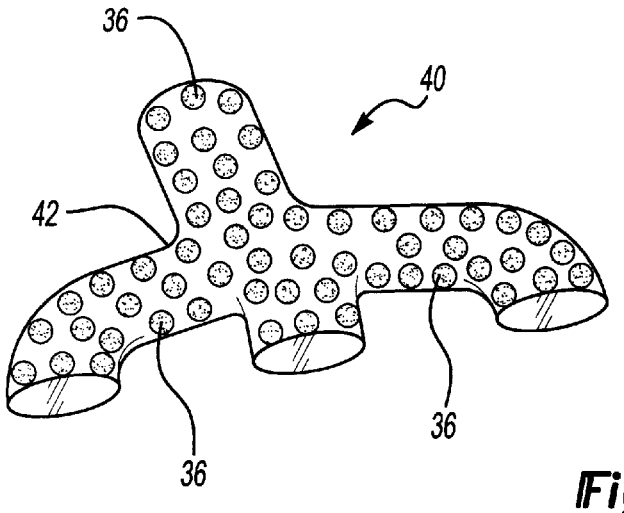
FIG. 6B is a schematic illustration of a step of the method of manufacture of the present invention.

Referring to FIG. 6A, the first step (step 100 of FIG. 7) is the forming of a first inner mold core 40 having an outer contour 42. The outer contour 42 produces the desired inner surface 32 of the finished component 10 such as the above described exhaust passageway 34 (FIG. 2).

The inner mold core 40 may be manufactured by any known method, such as the disclosed casting. The core casting cavity 44 includes an inner contour 46 which forms the outer contour 42 of the inner mold core 40. Preferable examples of the material for the inner mold core 40 include metallic materials having a melting temperature below that of the finished component material 10, such as Tin-Bismuth alloy.

The next step (step 104, of FIG. 7) includes temporarily attaching the plurality of ceramic members 36 to the inner mold core 40. The ceramic members 36 may be attached to the entire outer contour 42 or to selected locations of the finished component 10 which will be exposed to high temperatures. In one disclosed embodiment, the ceramic members 36 are temporarily attached directly to the inner mold core 40 by a simple adhesive. Preferably, the adhesive is non-toxic.

Alternatively, referring to FIG. 6AA another disclosed embodiment (steps 102*a*–102*b*, of FIG. 7) includes temporarily attaching the plurality of ceramic members 36 to an inner contour 46' of the core casting cavity 44' by an adhesive. The adhesive preferably only lightly tacks the ceramic members 36 to the inner contour 46'. Again, the ceramic members 36 may be attached to the inner contour 46' of the core casting cavity 44' or to selected locations which correspond to desired locations on the finished component 10. By lightly tacking the ceramic members 36 to the inner contour 46' the ceramic members will be transferred to the outer contour 42' of the inner mold core 40'.

Figure 6C:
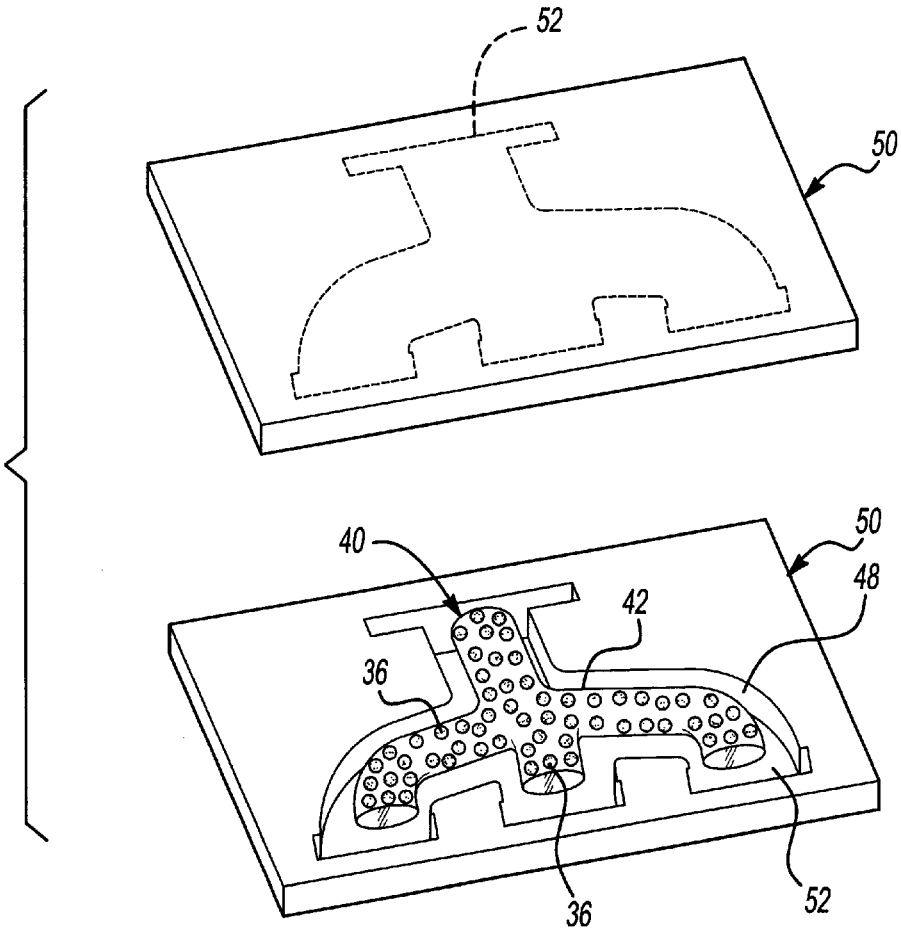
FIG. 6C is a schematic illustration of a step of the method of manufacture of the present invention.

Referring to FIG. 6C, the next step (step 104, of FIG. 7) is the step of overmolding a non-metallic material (shown schematically at 48) over the surface of the inner mold core 40 in a known manner. The inner mold core 40 having the ceramic members 36 attached to its outer contour 42 is placed in position within an outer mold 50 having a outer core casting cavity 52 which receives the non-metallic material 48 to form the outer surface 30 of the finished component 10.

Outer mold 50 is sealed and the non-metallic material 48 for forming finished component 10 is injected or otherwise filled in between the inner mold core 40 and outer core casting cavity 52 of the outer mold 50. The non-metallic material used in this step is not particularly limited, and various plastics as described above, may be used singly or in combination. The inner mold core 40 having the ceramic members 36 attached to its outer contour 42 is now surrounded by the molten non-metallic material 48 within the outer core casting cavity 50.

During the setting of non-metallic material 48, the ceramic members 36 become embedded within what will become the inner surface 32 of the finished component 10. Although a single non-metallic material is molded over the inner mold core 40 in a single step in the illustrated embodiment, two or more different non-metallic materials may be molded in additional steps over the inner mold core 40 until the desired outer surface 32 is formed.

Figure 6D:
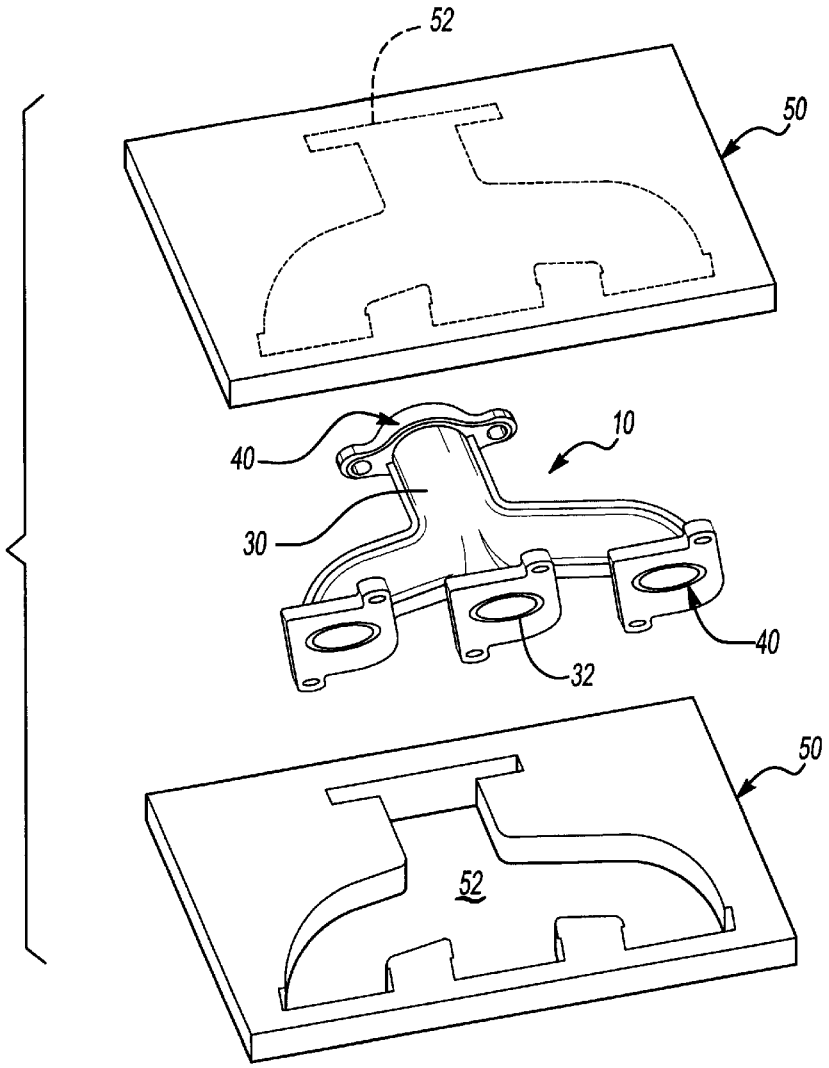
FIG. 6D is a schematic illustration of a step of the method of manufacture of the present invention.

Referring to FIG. 6D, the outer core casting cavity 50 is separated after the non-metallic material 48 has set. The outer surface 32 of the finished component 10 is now substantially complete while the inner mold core 40 remains within the finished component 10. Unnecessary portions of the outer surface may now need to be cut away in a known manner to obtain the desired finished component 10 outer surface 32 contours.

Figure 6E:
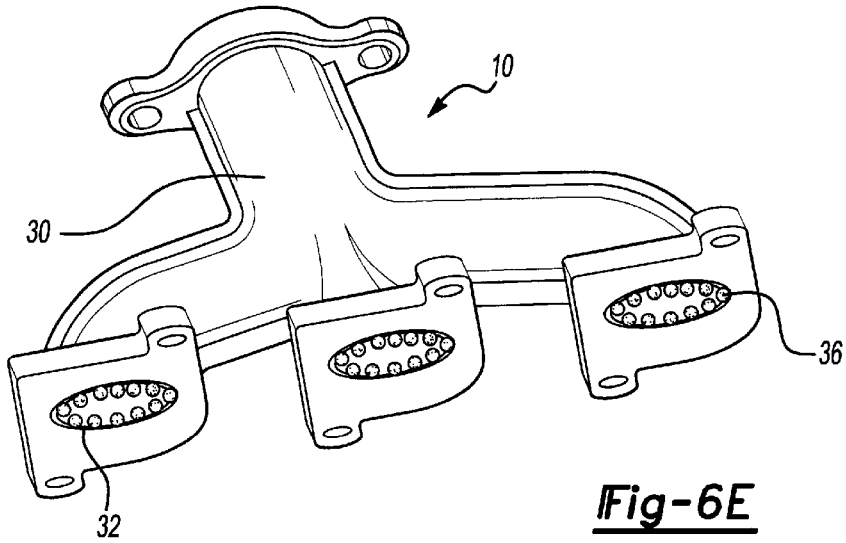
FIG. 6E is an expanded view of the finished component manufactured in accordance with the present invention.
Figure 7:
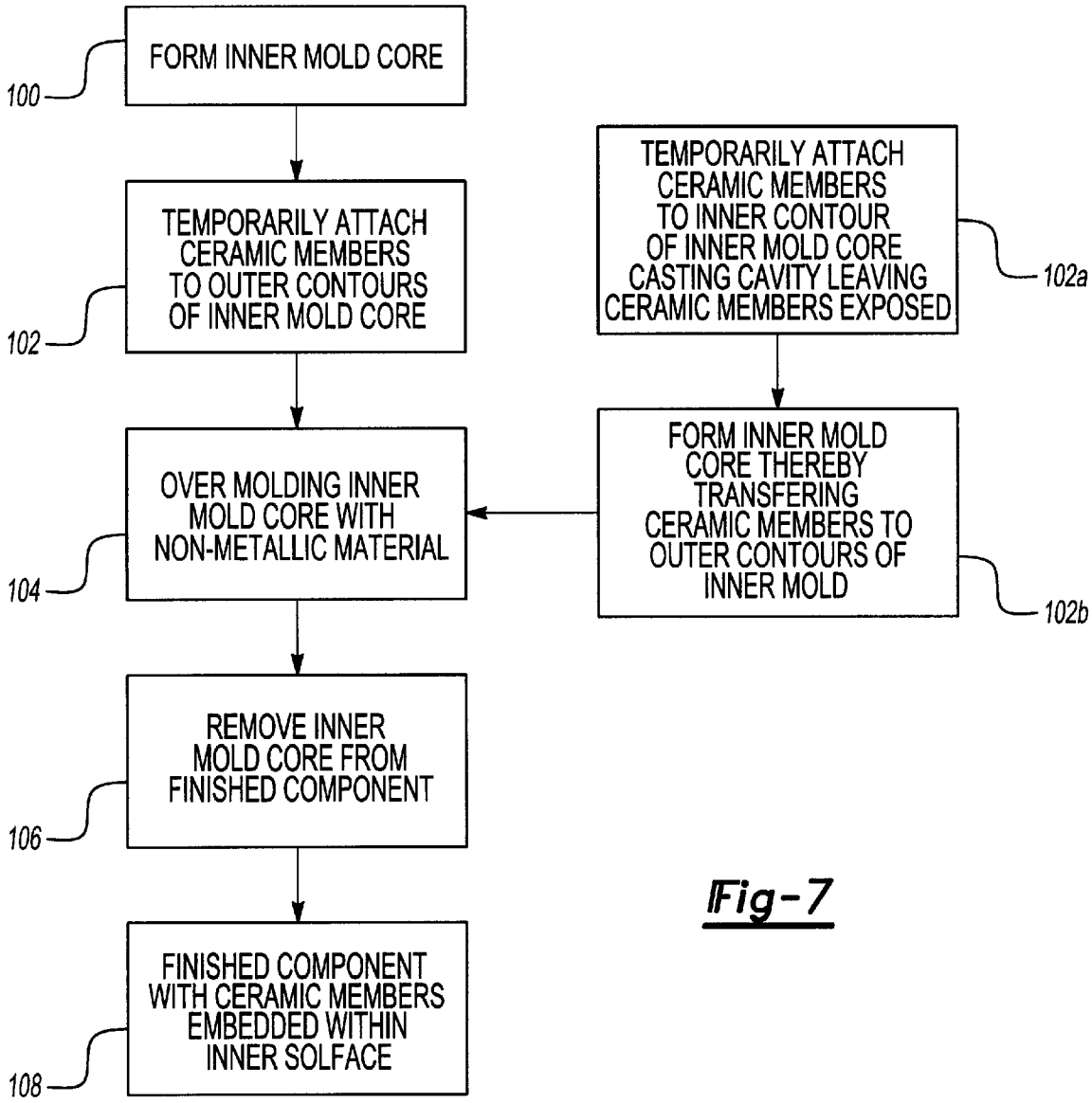
FIG. 7 is a flow diagram showing the steps of an embodiment of the process of the present invention.

Referring to FIG. 6E, the inner mold core 40 is now destructively removed leaving the ceramic members 36 embedded in the inner surface 30 of the finished component 10 (Step 108 of FIG. 7). Preferably, the inner mold core 40 is removed by melting as known in a variety of lost core molding processes. Because the inner mold core 40 has a melting temperature below that of the set non-metallic material, the finished component 10 is unaffected. The inner surface 32 now includes the plurality of embedded ceramic members 36 to provide a highly heat resistant and lightweight exhaust passageway 34 for directing the exhaust gas as described above.

The basic molding techniques discussed above may rely upon steps and parameters as known in the basic art of lost core molding. It is the inclusion of the ceramic particles into the inner core which is inventive here.

The foregoing description is exemplary rather than limiting in nature. Many modifications and variations of the present invention are possible in light of the above teachings. The preferred embodiments of this invention have been disclosed, however, one of ordinary skill in the art would recognize that certain modifications are possible that would come within the scope of this invention. It is, therefore, to be understood that within the scope of the appended claims, the invention may be practiced otherwise than as specifically described. For that reason the following claims should be studied to determine the true scope of protection given for this invention.

What is claimed is:

1. A vehicle gas directing component comprising:

a substantially plastic duct for directing a gas, said duct having an inner surface; and a plurality of ceramic members partially embedded in said inner surface said plurality of ceramic members forming a substantially non-continuos layer arranged along said inner surface to form a boundary layer between said gas and said inner surface exposed through said substantially non-continuos layer.

2. The component as recited in claim 1, wherein said ceramic members are ceramic spheres.

3. The component as recited in claim 1, wherein said ceramic members are hollow ceramic spheres.

4. The component as recited in claim 1, wherein said ceramic members are of a substantially uniform diameter within a range from 0.75 to 1 inches.

5. The component as recited in claim 1, wherein said ceramic members form a substantially non-continuous layer, partially embedded within said inner surface.

6. The component as recited in claim 1, wherein said ceramic members include a plurality of grooves.

7. The component as recited in claim 1, wherein said component is a vehicle exhaust component.

8. The component as recited in claim 1, wherein said component is an exhaust manifold.

9. A vehicle exhaust manifold comprising:

a substantially plastic duct for directing an exhaust gas, said duct having an inner surface; and a plurality of ceramic members partially embedded in said inner surface, said plurality of ceramic members forming a substantially non-continuos layer arranged along said inner surface in relation to a flow direction of said exhaust gas to form a boundary layer between said gas and said inner surface exposed through said substantially non-continuos layer.

10. The component as recited in claim 9, wherein said ceramic members are ceramic spheres.

11. The component as recited in claim 9, wherein said ceramic members are hollow ceramic spheres.

12. The component as recited in claim 9, wherein said ceramic members are of a substantially uniform diameter within a range from 0.75 to 1 inches.

13. A vehicle exhaust manifold comprising:

a substantially plastic duct for directing an exhaust gas, said duct having an inner surface; and a plurality of ceramic spheres partially embedded in said inner surface, said plurality of ceramic spheres forming a substantially non-continuos layer arranged along said inner surface in relation to a flow direction of said exhaust gas to form a boundary layer between said gas and said inner surface exposed through said substantially non-continuos layer.

14. The component as recited in claim 13, wherein said ceramic spheres are of a substantially uniform diameter within a range from 0.75 to 1 inches.

15. The component as recited in claim 13, wherein said ceramic members form a substantially non-continuous layer, partially embedded within said inner surface.

16. The component as recited in claim 13, wherein said ceramic members include a plurality of grooves.

* * * * *